US005611672A

United States Patent [19]

Modesitt

[11] Patent Number: 5,611,672

[45] Date of Patent: Mar. 18, 1997

[54] PUMPING CHAMBER MOVEMENT ACTIVATED DOWNHOLE PNEUMATIC PUMP

[75] Inventor: D. Bruce Modesitt, San Carlos, Calif.

[73] Assignee: Transnational Instruments, Inc., San Carlos, Calif.

[21] Appl. No.: 470,674

[22] Filed: Jun. 5, 1995

Related U.S. Application Data

[63] Continuation-in-part of Ser. No. 157,689, Nov. 24, 1993, abandoned.

[51] Int. Cl.[6] ..... F04F 1/06

[52] U.S. Cl. ..... 417/131; 417/140

[58] Field of Search ..... 417/61, 126, 131, 417/140

[56] References Cited

U.S. PATENT DOCUMENTS

| | | | |
|---|---|---|---|
| 709,212 | 9/1902 | Elliott | 417/140 |
| 761,065 | 5/1904 | Elliott | 417/140 |
| 1,261,905 | 4/1918 | Cochran . | |
| 1,295,446 | 2/1919 | Denizet | 417/140 |
| 1,675,772 | 7/1928 | Teeple | 417/140 |
| 1,893,066 | 1/1933 | Zellhoefer . | |
| 2,184,706 | 12/1939 | Bennett . | |
| 2,612,118 | 9/1952 | Harvie . | |
| 4,467,831 | 8/1984 | French . | |
| 4,774,874 | 10/1988 | Adahan . | |
| 4,872,473 | 10/1989 | Agostino . | |
| 5,004,405 | 4/1991 | Breslin | 417/131 |
| 5,090,299 | 2/1992 | Santi et al. . | |
| 5,141,404 | 8/1992 | Newcomer et al. . | |
| 5,141,405 | 8/1992 | Francart, Jr. . | |
| 5,174,722 | 12/1992 | Lybecker | 417/9 |
| 5,470,206 | 11/1995 | Breslin | 417/131 |

FOREIGN PATENT DOCUMENTS

| | | |
|---|---|---|
| 231062 | 11/1960 | Australia . |
| 856718 | 11/1952 | Germany . |
| 1025724 | 3/1958 | Germany . |

*Primary Examiner*—Timothy Thorpe
*Assistant Examiner*—Roland G. McAndrews, Jr.
*Attorney, Agent, or Firm*—Thomas Schneck

[57] ABSTRACT

A floatless pneumatic pump having an elongated housing including a sealable fluid entry aperture and a pipe communicating between an interior and an exterior of the housing, with the housing movably attached to the pipe for axial displacement therewith. The housing includes a bottom wall and a cylindrical side wall extending from the bottom wall and terminating in an opening. A switchable valve control having a pod closes the opening. The pod has a plurality of valve seats and a plurality of corresponding valve elements, with the plurality of valve seats defining at least one fluid inlet port and at least one fluid outlet port. The valve elements alternatingly seal the inlet and outlet ports in relation to the axial displacement of the housing, allowing both fluid to ingress through a sealable fluid entry aperture and fluid to egress through the pipe. Another embodiment includes a variable buoyant actuator coupled to the pod to alternatingly place the valve elements in sealing engagement with the inlet and outlet ports in response to a level of fluid in the housing. The variable buoyant actuator includes a neutral density weight disposed proximate to the bottom wall, and a buoyant amplifier, disposed opposite to the neutral density weight, proximate to the pod. In this manner, the use of a float may be obviated or a float of substantially reduced volume may be employed.

14 Claims, 10 Drawing Sheets

PUMPING CHAMBER MOVEMENT ACTIVATED DOWNHOLE PNEUMATIC PUMP

CROSS-REFERENCE TO RELATED APPLICATION

This is a continuation-in-part of patent application Ser. No. 08/157,689, filed Nov. 24, 1993, now abandoned.

TECHNICAL FIELD

The invention relates to subsurface fluid pumps driven by compressed gas, and in particular, to such a pump having a valve controlled flowmeter system.

BACKGROUND ART

Pneumatic subsurface pumps are well known. Typically, they are used to remove fluids from a hole, or a well. In this manner, the pump is placed in a well with separate lines attached to it for liquid discharge, compressed air flow, and venting. A chamber of the pump fills with a liquid when compressed air has been completely exhausted from it. After the pump is full of liquid, compressed air is introduced into the chamber to pressurize it and cause the water to flow through a liquid discharge pipe.

Fluid enters the pump, typically through a liquid inlet port, flowing past an inlet check valve into the chamber. A float is disposed within the chamber to actuate a valve system to change the state of the pump from a pressurized state to an exhaust state. The float moves in relation to the volume of liquid in the chamber.

U.S. Pat. No. 5,141,404 to Newcomer et al. shows a subsurface pump for removing underground fluids from a well that features an elongated body having an inner and outer chamber with a valve controlling the flow of compressed air into the outer chamber in response to the motion of a float. The float is disposed within the outer chamber and slides up and down in accord with the fluid level within that chamber. As the fluid level increases, the float traverses along the length of the elongated body until it contacts a first float stop on a actuator rod. The actuator rod is attached to an actuator head disposed in a magnetic field.

At a preset point, the upward force of the float overcomes the magnetic field and changes the state of the inner chamber from an exhaust state to a pressurized state, by allowing compressed air to ingress into the chamber. The compressed air causes the fluid to exit the pump by flowing the fluid from the outer chamber through the inner chamber. As the fluid decreases in the chamber, the float lowers until it reaches the lower float actuator rod stop. The continuing weight of the float on the stop pulls the rod down and once again causes the pump to change states, i.e., pressurized to exhaust. Similar pneumatic pumps are shown in U.S. Pat. No. 5,004,405 to Breslin and U.S. Pat. No. 4,467,831 to French. A major drawback with the aforementioned pumps is the size of the float necessitated to change the pump from a pressurized to an exhaust state, resulting in a reduced amount of flow for a given size pump.

It is an object, therefore, of the present invention to provide a pump with a substantially increased flow rate by reducing the size of the float contained in the pump chamber.

It is another object of the present invention to provide a pump with a flow metering system.

SUMMARY OF THE INVENTION

The above objects have been achieved with a pneumatic pump having an elongated housing including a sealable fluid entry aperture and a pipe communicating between an interior and an exterior of the housing, with the housing movably attached to the pipe for axial displacement therewith. The housing includes a bottom wall and a cylindrical side wall extending from the bottom wall and terminating in an opening. A pod providing switchable valve control closes the opening. The pod has a plurality of valve seats and a plurality of corresponding valve elements, with the plurality of valve seats defining at least one fluid inlet port and at least one fluid output port. The valve elements alternatingly seal the inlet and outlet ports in relation to the axial displacement of the housing, allowing fluid ingress through the sealable fluid entry aperture and fluid egress through the pipe.

In a second embodiment, a variable buoyant actuator is coupled to the pod to alternatingly place the valve elements in sealing engagement with the inlet and outlet ports in response to a level of fluid in the housing. The variable buoyant actuator includes a neutral density weight disposed proximate to the bottom wall, and a buoyant amplifier disposed opposite to the neutral density weight, disposed proximate to the pod. For purposes of this application, a neutral density weight is defined as any weight having a density substantially equal to the fluid to be pumped so that the net weight of the object submerged in the fluid is substantially equal to zero. The buoyant amplifier may be either an air-trap or a conventional float. In this manner, the use of a float may be obviated or a float of substantially reduced volume may be employed.

BEST MODE FOR CARRYING OUT THE INVENTION

Figure 1:
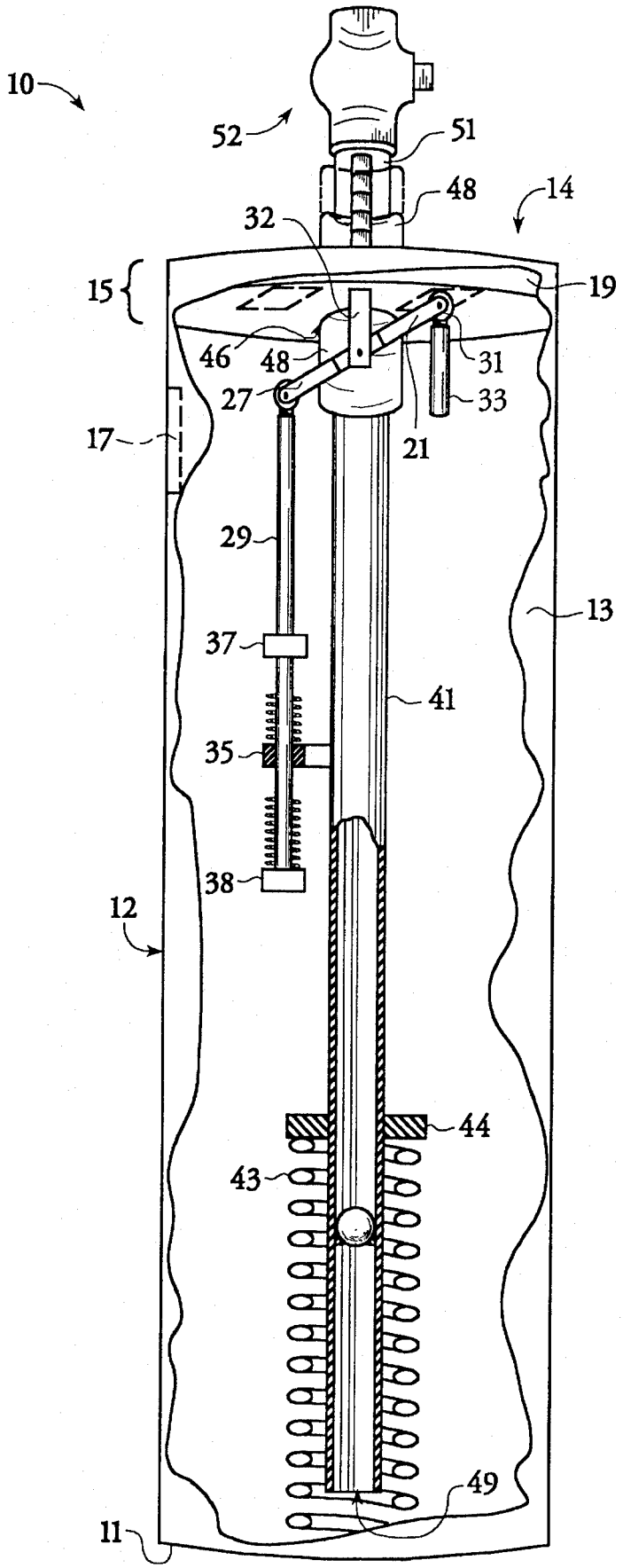
FIG. 1 is a side cutaway view of a downhole pneumatic pump in accord with the present invention.
Figure 2:
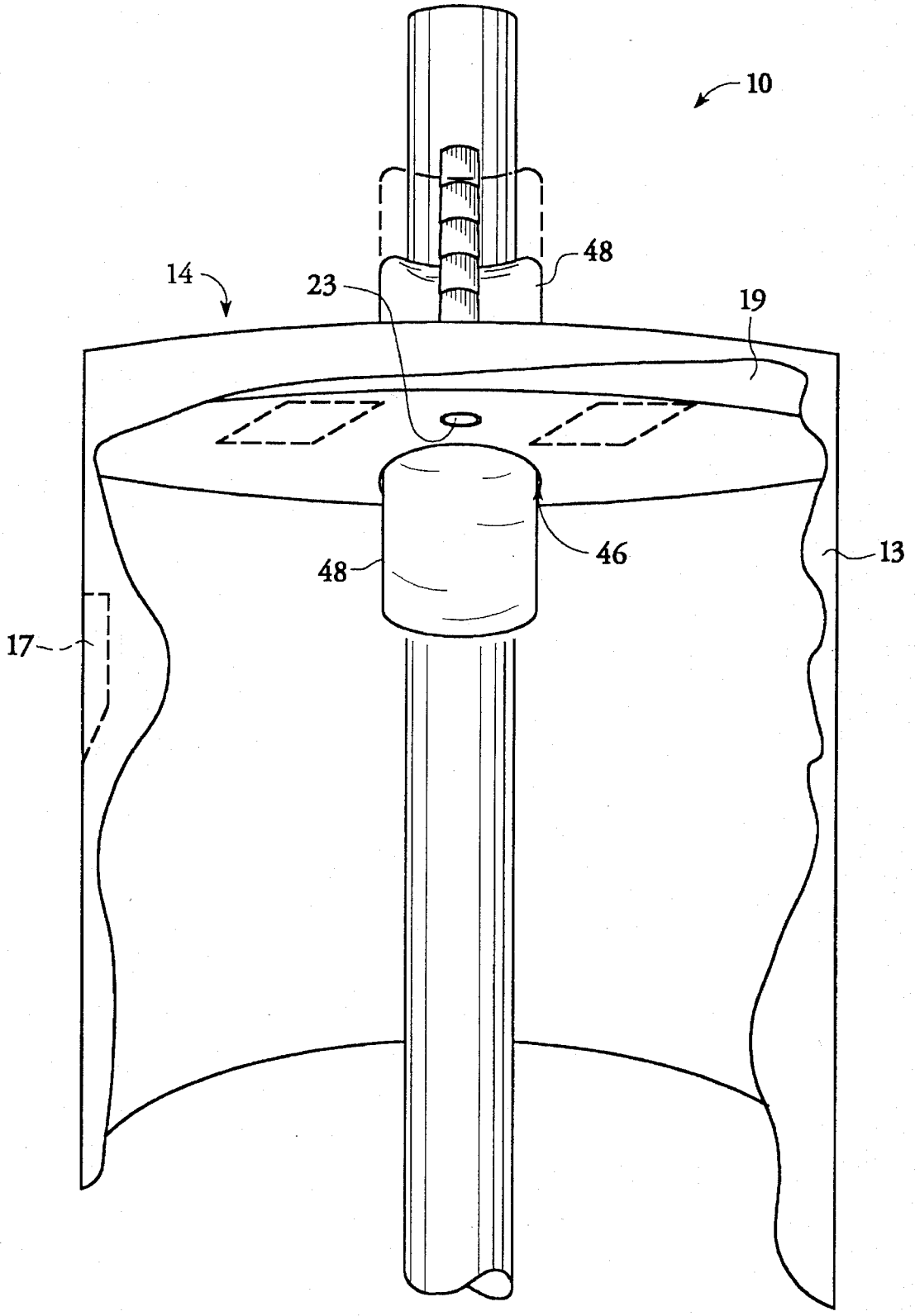
FIG. 2 is a detailed side cutaway view of a downhole pneumatic pump in accord with the present invention.

With reference to FIGS. 1 and 2, a downhole pneumatic pump 10 has an elongated cylindrical housing 13 which includes a bottom wall 11 and a cylindrical sidewall 12 extending from the bottom wall terminating in an opening 14. A valve control mechanism 15 closes the opening 14. A sealable flap valve 17 in the sidewall 12 of the chamber 13, shown more clearly in FIG. 2, admits fluid from a downhole environment, such as a well, into the elongated housing 13. A valve control mechanism features a pod 19 made of ferromagnetic material. A pair of spaced apart inlet and outlet fluid ports are included in the pod 19 and are opened and closed by valve elements, supported from the seesaw member 21, discussed more fully below with respect to FIGS. 4–6. The seesaw member 21 has a first end 27 carrying a rod 29 and a second end 31 carrying a counterweight 33. A yoke 35 is rigidly connected to a pipe 41 that extends along the length of sidewall 12. The rod 29 passes through the yoke 35, and includes a pair of blocks 37 and 38 positioned on opposite sides of the yoke 35 to constrain the motion of the cylindrical housing 13. The fixed constraining block 37 allows the housing 13 to push the seesaw member 21 upwardly, while the lower block 38 allows the housing 13 to pull the seesaw member downwardly. The base of the pipe 41 has a fluid inlet hole 49 where water, displaced from the housing 13 by compressed air, may be discharged upwardly and outwardly by means of a nozzle 51 at the top of the pipe 41 through a check valve 52.

Figure 16:
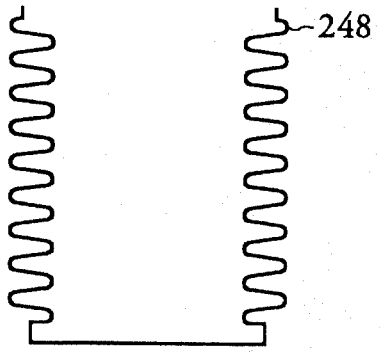
FIG. 16 is a side view of an alternate embodiment of a resilient member shown in FIG. 1, in accord with the present invention.

The housing 13 is movably attached for axial displacement with respect to the pipe 41. To facilitate this movement, a resilient member, such as spring 43, supports the housing 13. The spring 43 is fixedly attached to the bottom wall 11 and extends upwardly therefrom surrounding the pipe 41 and terminates resting against a bearing member 44. The bearing member 44 extends radially outward from the pipe 41. The pod 19 includes an aperture 46 through which the pipe 41 passes. A flexible member 48 is disposed in the aperture 46 extending between the pipe 41 the pod 19. The flexible member 48 maintains a fluid-tight seal between the pipe 41 and the pod 19 as the housing 13 undergoes axial displacement. The flexible member 48 may include a polyurethane tube fitted over the pipe 41, or it may be a rolling diaphragm, a bellows, formed from nickel or rubber, or any other device that may provide a fluid-tight seal with minimal friction between the pipe 41 and the pod 19 with the bellows shown more clearly in FIG. 16.

Figure 3:
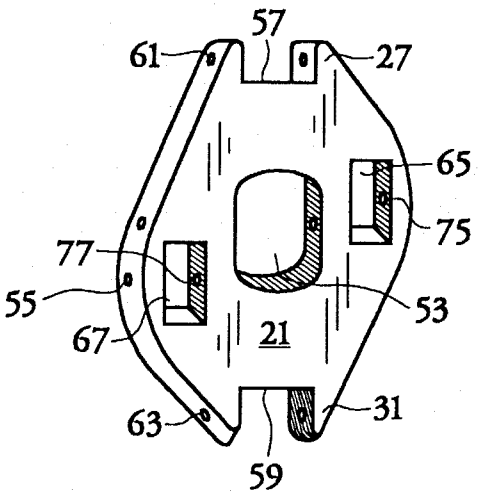
FIG. 3 is a perspective view of a seesaw member shown in the pump of FIGS. 1 and 2.

In FIG. 3, the seesaw member 21 may be seen to have a central aperture 53 through which the pipe 41 passes. A pivot hole 55 is located on each side of the seesaw, each of which receives a pivot pin. In this manner, the seesaw member is pivotally attached to the pod 19, shown more clearly in FIGS. 4–6. A pair of opposed notches 57 and 59 seat magnetic rollers having axles which fit into holes 61 and 63 at opposed seesaw respective ends 27 and 31. A pair of opposed central apertures 65 and 67 carry upright valve elements pivoted by axles mounted at respective holes 75 and 77.

Figure 6:
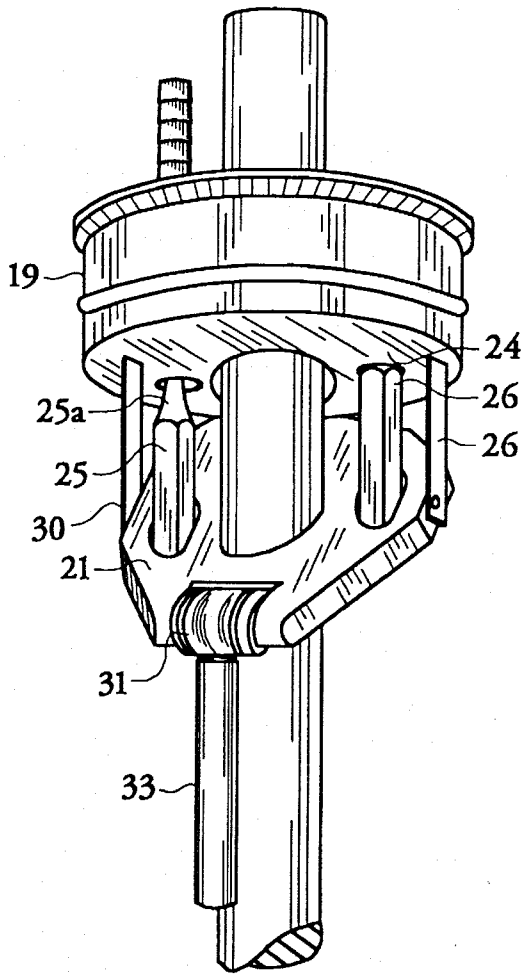
FIGS. 5–6 are operation views of the pumps of FIGS. 1 and 2.
Figure 5:
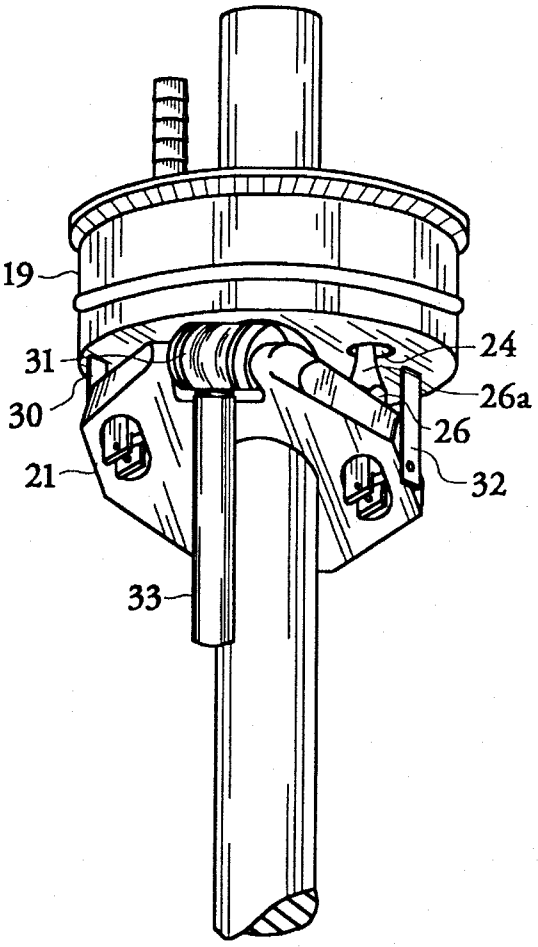
Figure 4:
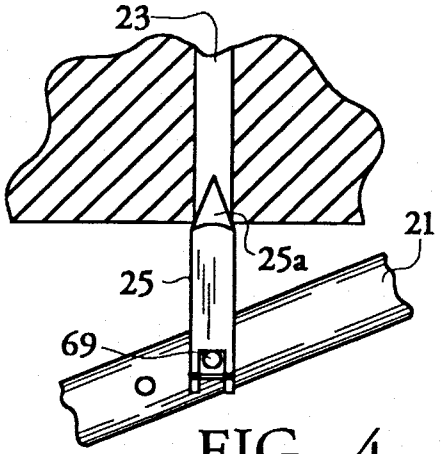
FIG. 4 is a side plan view of a valve in the downhole pump of FIGS. 1 and 2.

Referring to FIGS. 4–6, seesaw member 21 carries a valve element 25 by means of pivot 69. A similar arrangement is made for valve element 26. Valve element 25 includes a frusto-conical portion **25*a* to project into an air-inlet port 23. Valve element 26 includes a frusto-conical portion 26*a* to project into exhaust port 24. As shown in FIG. 5, counterweight 33 is up and latched in place as magnetic roller 31 secures the position of the seesaw member 21 against the ferromagnetic pod 19. The seesaw member 21 is shown pivotally mounted to the pod 19 via support members 30 and 32. In a first bistable position, the frusto-conical portion 26*a* of valve element 26 is removed from the exhaust port 24, allowing pressurized fluid, e.g., air, to be vented through the pod 19. The frusto-conical portion 25*a* of valve element 25 projects into air-inlet port 23. In this manner, fluid, e.g., a liquid, may enter flap valve 17, shown in FIG. 2. As the water fills the housing 13, a force is created, causing the spring 43 to elongate as the housing 13, pod 19 and seesaw member 21 move downwardly with respect to the pipe 41. As the housing undergoes downwardly axial displacement, the flexible member 48 also extends to facilitate the axial movement, while maintaining a fluid-tight seal between the pipe 41 the pod 19, shown by the dotted lines in FIGS. 1 and 2. After a predetermined distance, the yoke 35 contacts the lower block 38, pulling the seesaw member 21** downwardly in a second bistable position.

FIG. 6 shows the seesaw member 21 in a second bistable position with the frusto-conical portion **25*a* of valve element 25 removed from the air-inlet port 23, allowing compressed air therethrough. The frusto-conical portion (not shown) of valve element 26 projects into exhaust port 24, with the counterweight 33 shown in the down position. In this manner, the liquid is forced into the fluid inlet hole 49 of the pipe 41 to be displaced from the housing 13, as described above. Exiting fluid decreases the weight on the spring 43, allowing both the spring 43 to retract and the housing 13, pod 19 and seesaw member 21 to be axially displaced upwardly with respect to the pipe 41. Referring again to FIG. 1, after a predetermined distance the yoke 35 contacts the upper block 37 pushing the seesaw member 21** upwardly to the first bistable position, as described above. In this fashion, the pumping of fluids in achieved by a floatless pump. This provides a higher flow rate for a given size pump than would be allowable with a pump using a float. In addition, a floatless pump requires less air to achieve a given flow-rate.

Figure 7:
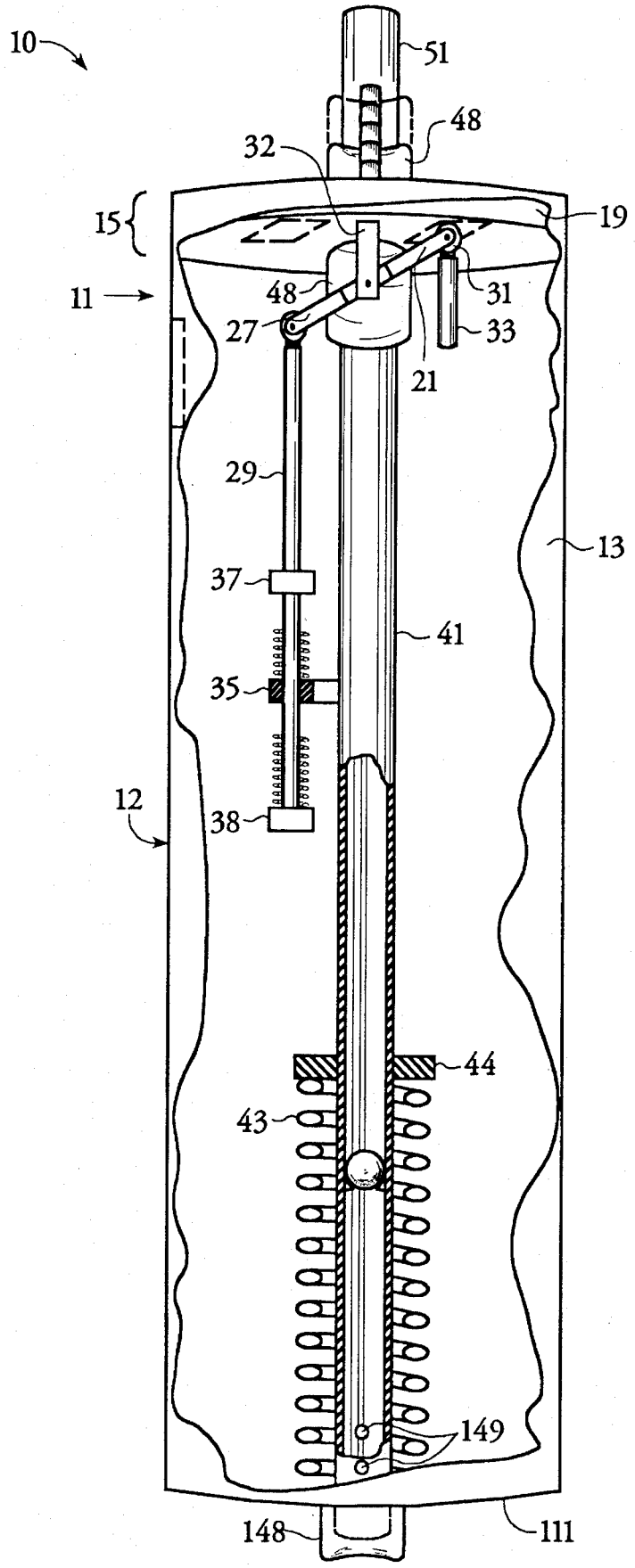
FIGS. 7–12 are side cutaway views of an alternate embodiment of the downhole pump in accord with the present invention.

FIG. 7 show another embodiment of the pump shown in FIGS. 1–6. In this embodiment, the bottom wall 111 includes a second aperture with a flexible member 148 disposed therein to form a fluid-tight seal along the circumference of the aperture. The flexible member 148 may include a polyurethane tube, fitted over the pipe 41 and between the bottom wall and the pipe 41, forming a fluid-tight seal. In this manner, fluid inlet holes 149 are disposed in the side of the pipe 41. As before, with respect to the first flexible member 48, the second flexible member 148 may also include a rolling diaphragm, a bellows, formed from nickel or rubber, or any device that may provide a fluid-tight seal. Having flexible members at opposite ends of the housing 13 reduces the resulting force directed downwardly toward the bottom wall 111, during pressurization.

Figure 8:
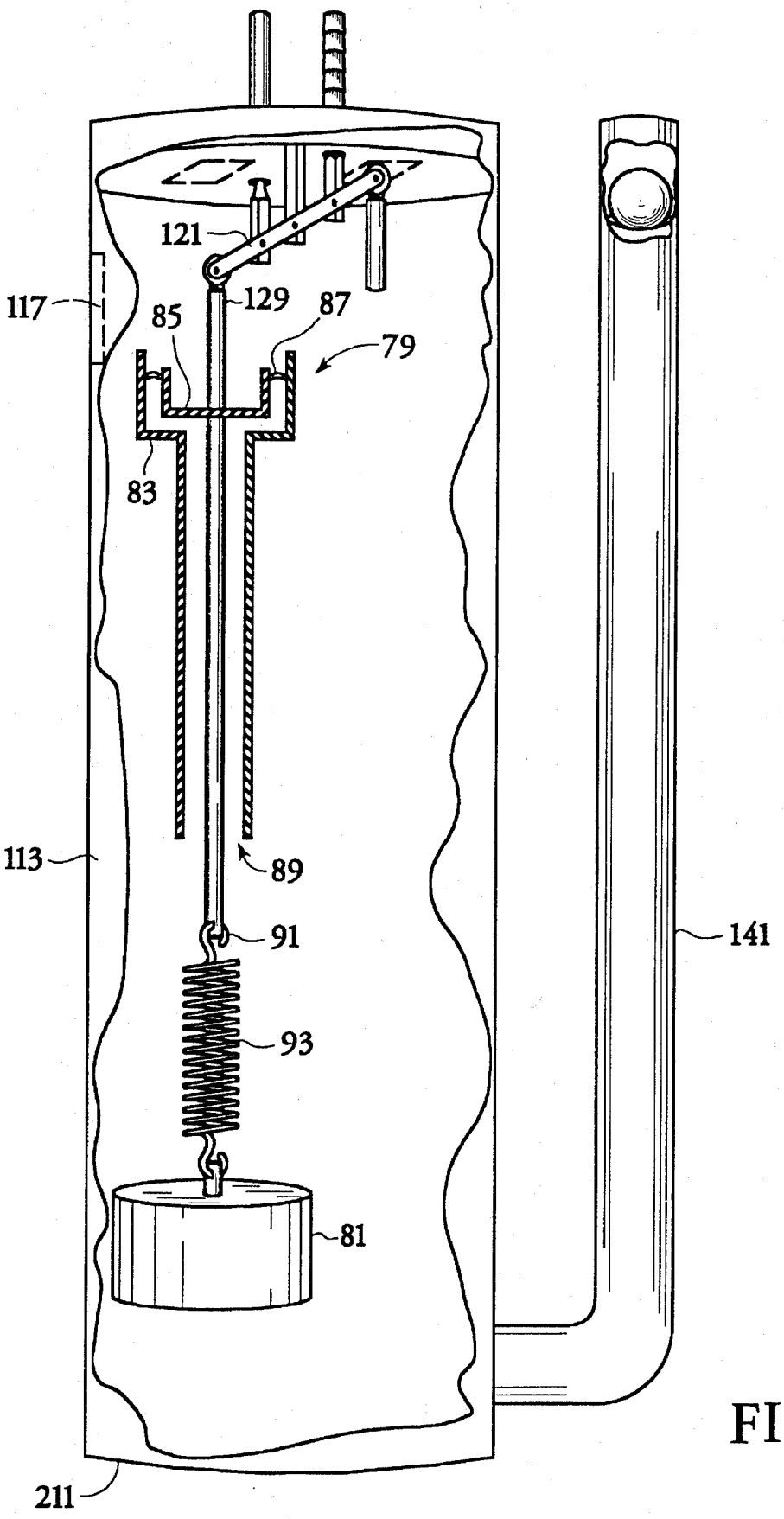

FIG. 8 shows the preferred embodiment of the present invention with the housing 113 being fixedly attached to the pipe 141 and including a variable buoyant actuator. The variable buoyant actuator includes a rod 129 having two ends, with a neutral density weight 81 connected to one end, and an air-trap 79 connected proximate to the second end. A seesaw member 121 is connected to the second end with the air-trap 79 being positioned between the seesaw member 121 and the neutral density weight 81. The air-trap 79 includes a housing 83, a piston 85, movable with respect to the housing 83, and a flexible member 87 disposed between the piston 85 and the air-trap housing 83 to maintain a fluid-tight seal therebetween. The air-trap housing 83 is fixedly attached to the inner surface of the housing 113 between the seesaw member 121 and the neutral density weight. The air-trap housing 83 extends away from the flexible member 87 terminating in an opening 89, facing the bottom wall 211. The piston 85 is rigidly connected to the rod 129, with the rod 129 extending towards the bottom wall 211. A terminus 91 of the rod 129 is positioned between the opening 89 and the bottom wall 211. The neutral density weight 81 is coupled to the terminus 91. Although a spring 93 is shown as being disposed between the neutral density weight 81 and the terminus 91, it is not necessary to have the spring 93. The neutral density weight 81 may be attached directly to the terminus 91. It is preferred that the neutral density weight 81 has a density proximate to the density of the fluid that will fill the housing 113, with the volume of the neutral density weight 81 being sufficiently small so as not to cause a change in the bistable state of the seesaw member 121 when submerged in the fluid. For example, the neutral density weight 81 may be formed from High Density Polyethylene weighted with stainless steel. In this fashion, the neutral density weight 81 provides a net downward force that is less when submerged in the fluid than when the fluid is positioned below it.

It should be understood that a neutral density weight need not be used. A device having a density greater than that of the fluid could be used. The important factor is that the air-trap be sufficiently large to overcome the downward force exerted on the rod 129 due to the submerged weight of the device, thereby allowing a change in the bistable state of the pump.

In a first bistable position, the orientation of the valve elements, supported by the seesaw member 121, allows air in the housing 113 to exhaust, permitting fluid ingress through a sealable flap-valve 117. Water entering the housing 113 submerges the neutral density weight 81. The volume of the neutral density weight 81 is, however, insufficient to produce a buoyant force of sufficient magnitude to cause a change in the bistable state of the pump. As fluid continues to fill the housing 113, air is retained within the air-trap 79, producing a force against the piston 85. The force experienced by the piston 85 increases proportionally with the level of the fluid in the housing 113. After a predetermined amount of fluid fills the housing 113, the piston 85 is forced toward the seesaw member 121, moving it upwardly away from the bottom wall 211, closing the exhaust port and opening the air-inlet port. The orientation of the valve elements allows pressurized air to enter into the housing 113, forcing fluid to exit through the pipe 141. The bistable state of the pump will change after a predetermined amount of fluid has egressed through the pipe 141, so that the neutral density weight 81 is above the fluid. It is the mass of the neutral density weight 81 coupled with the reduction of air pressure on the piston 85 that allows the seesaw member 121 to change the bistable state of the pump. In this fashion, the out-of-fluid mass of the neutral density weight 81 pulls the seesaw member 121 downwardly toward the bottom wall 211.

Figure 9:
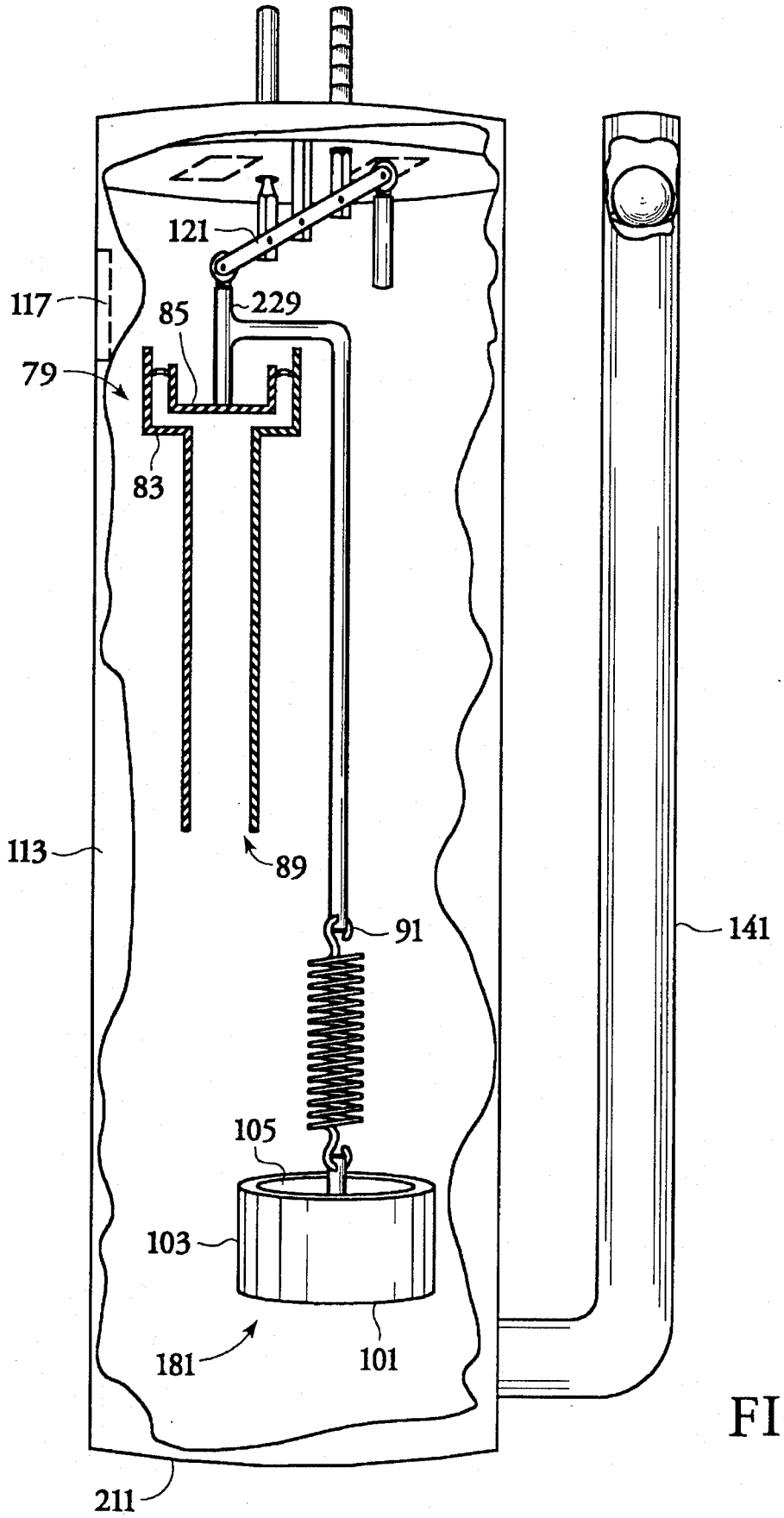
Figure 10:
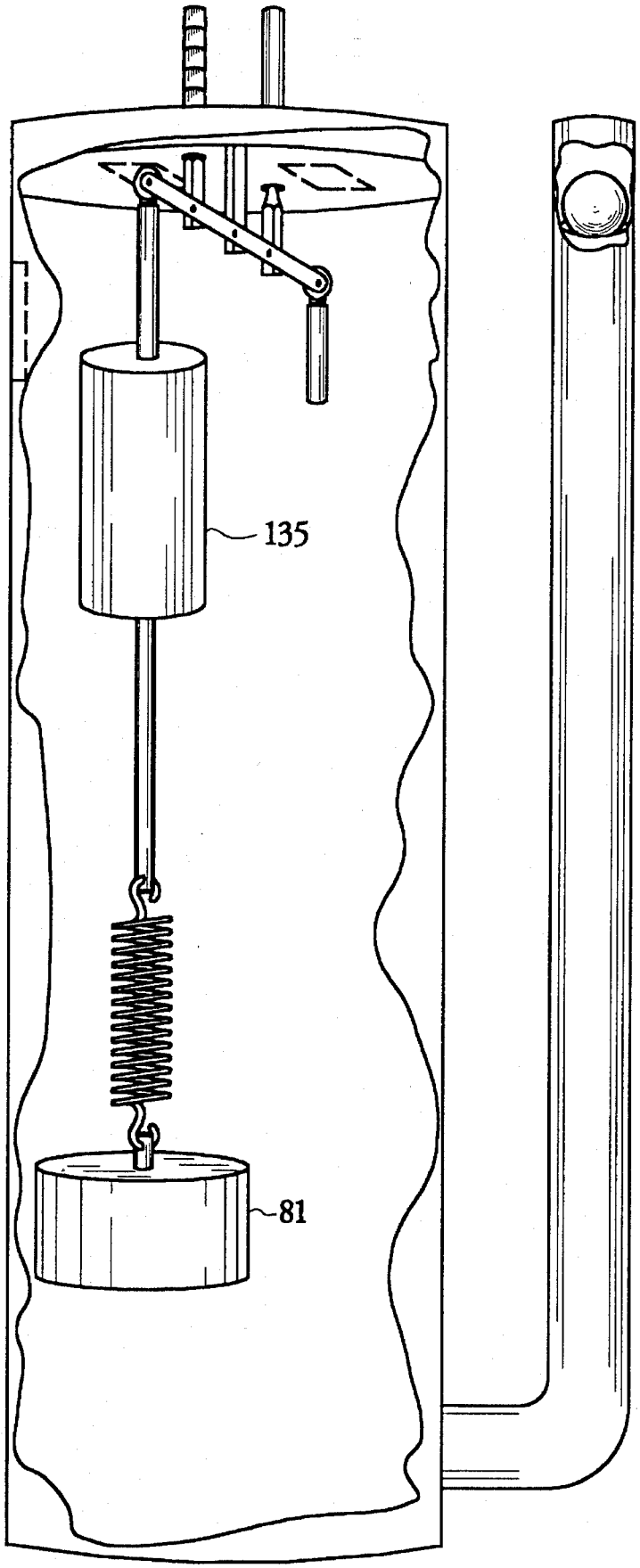

The air-trap 79 substantially increases flow rate per unit volume of the pump by reducing the volume of water required to be displaced in order to effectuate a change in the bistable state of the pump. This structure allows minimizing the volume of the neutral density weight 81 because the buoyant force provided by the neutral density weight is augmented/amplified by the air-trap 79. Although FIG. 8 shows the rod 129 extending through air-trap housing 83, this is not critical to practice the invention. Rather, rod 229 may bend around the air-trap, as shown in FIG. 9. In addition, the pipe 141 may be disposed outside of the housing 113, as shown in FIG. 8, or coaxially as shown in FIG. 1. In addition, the air-trap 179 may be replaced with a float 135, as shown in FIG. 10. The principles of operation are similar. However, employing the neutral density weight 81 allows using a much smaller float than would be, otherwise, possible to use.

Figure 11:
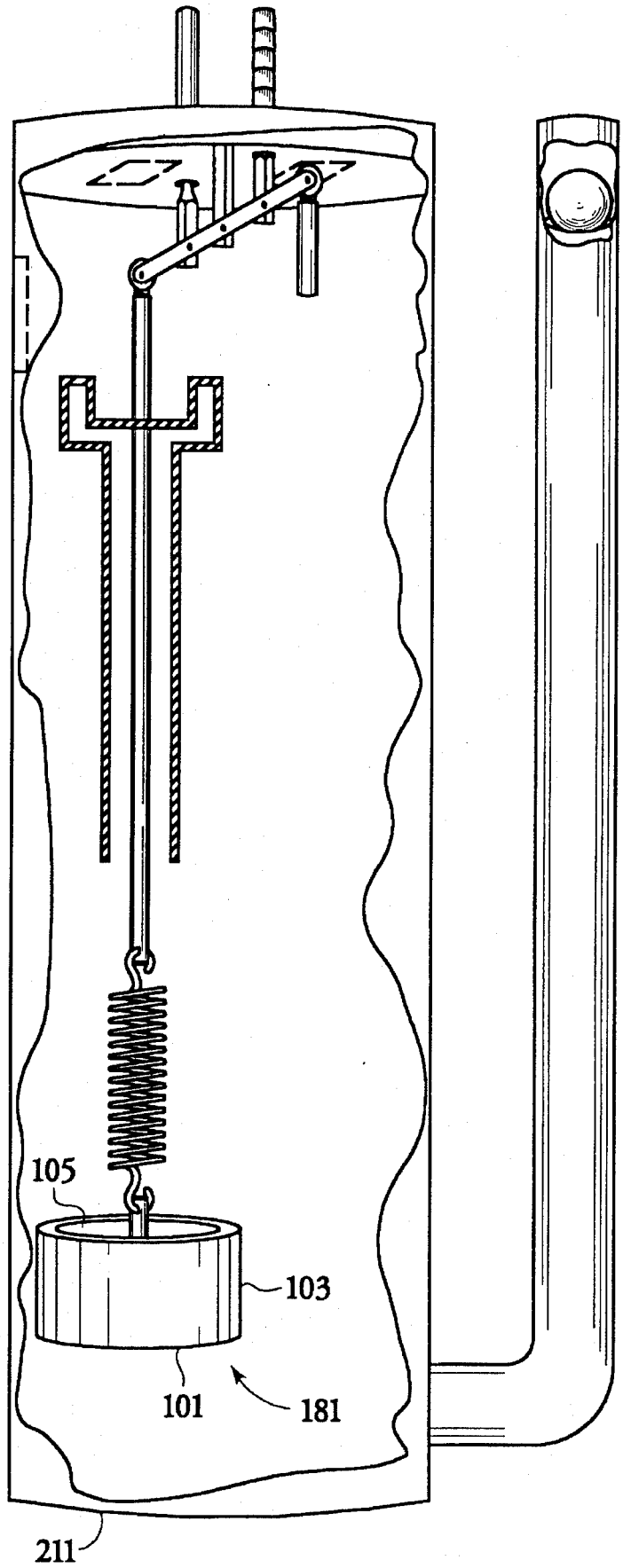

FIG. 11 shows another embodiment of the neutral density weight. In this embodiment, the neutral density weight 181 is a cup having a bottom surface 101 facing the bottom wall 211 with a cylindrical side wall 103 extending upwardly and terminating in an opening 105, opposite to the bottom surface 101. This design allows the cup 181 to be filled as fluid enters the housing 113, providing the cup 181 with a density nearly equal to the density of the fluid filling the housing 113. In addition, instead of the air-trap including a piston coupled to an air-trap housing via a flexible membrane, the air-trap is one piece. The displacement of the whole air-trap causes the seesaw member to move up or down.

Figure 12:
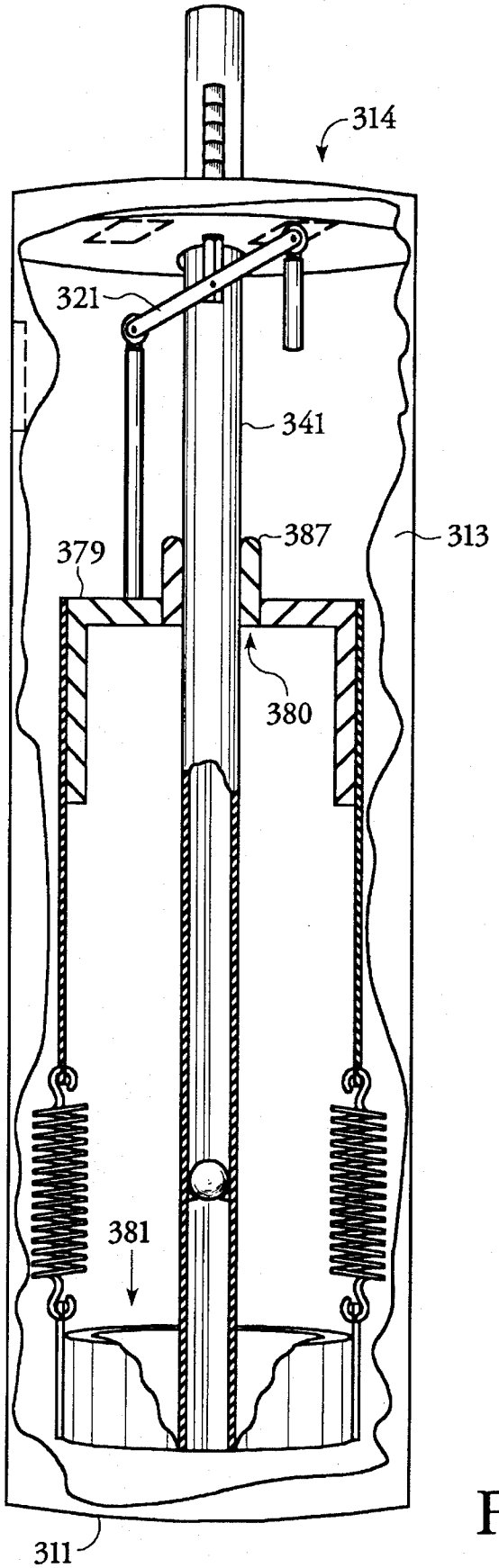

FIG. 12 shows yet another embodiment employing an air-trap 379 coupled to a neutral density weight 381. In this design, the neutral density weight 381 and the air-trap 379 are both disposed concentrically about the pipe 341. The neutral density weight 381 is disposed proximate to the bottom wall 311, and the air-trap 379 is distally positioned therefrom, proximate to the opening 314. The air-trap 379 includes an aperture 380 through which the pipe 341 passes. The air-trap 379 is movably coupled to the pipe 341 for axial displacement therewith via a flexible member 387 disposed within the aperture 380. As before, the flexible member 387 may be manufactured from any material that may provide a fluid-tight seal with minimal friction between the pipe 341 and the air-trap 379. In this embodiment, the neutral density weight 381 does not connect directly to the rod 329. Rather, the neutral density weight 381 is coupled to the rod 329 via the air-trap 379. Although FIG. 12 shows a cup as the neutral density weight 381, any type of neutral density weight may be employed so long as it has a density substantially equal to the density of the fluid that will fill the housing 313, with the volume sufficiently small so as not to cause a change in the bistable state of the seesaw member 321, once submerged in the fluid.

Figures 13, 14, 15:
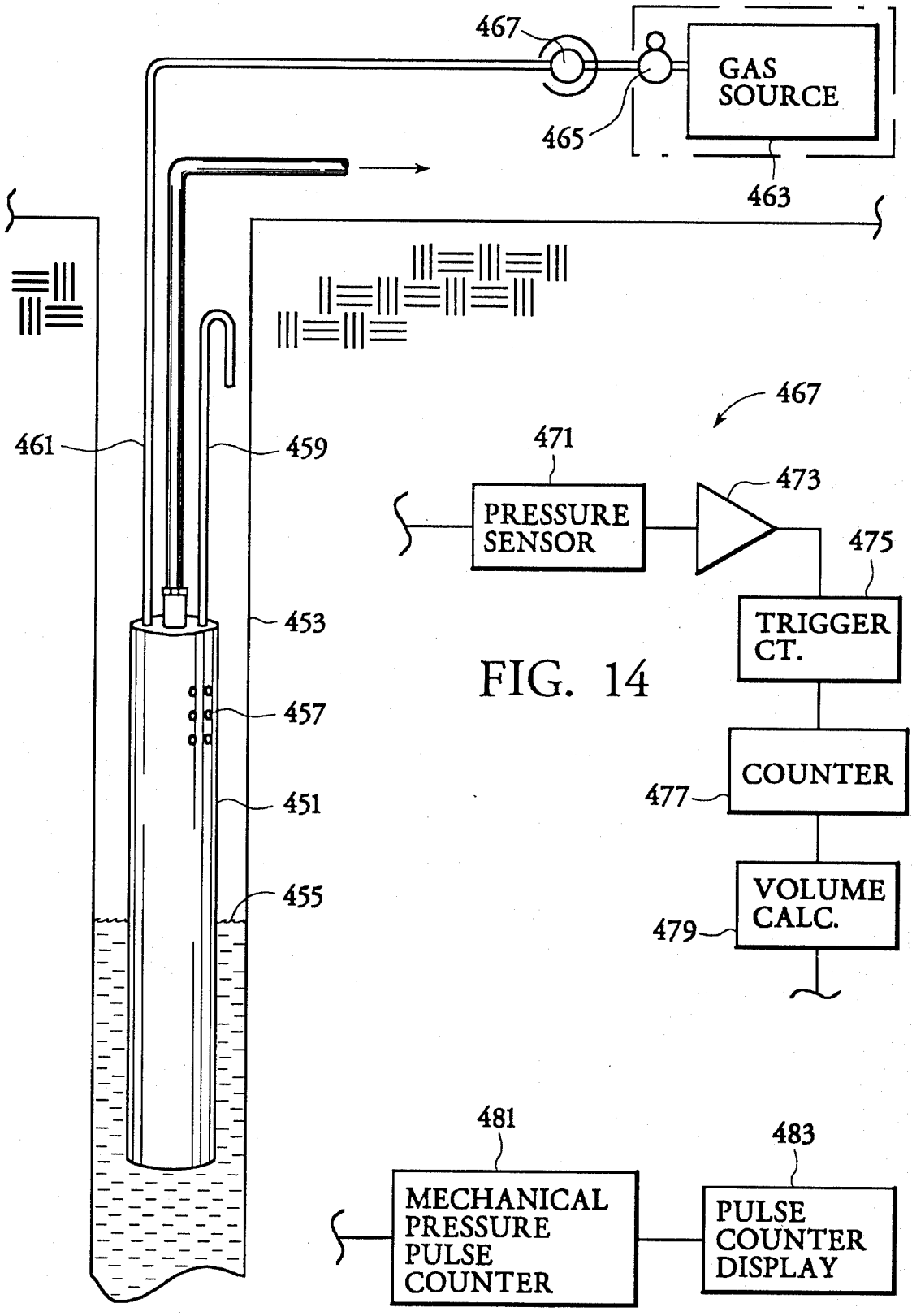
FIG. 13 is a side view of a downhole pump of the present invention situated in a well with connecting piping above ground level.
FIGS. 14–15 are electromechanical plan views of alternative circuits for counting pressure pulses associated with changes of position of the seesaw member in the pump in accord with the present invention.

In FIG. 13, the downhole pump 451 of the present invention is shown to reside in a well 453 having fluid to a level 455. When the level rises to the level of the inlet ports 457, the fill cycle begins, and air inside the housing is vented through the vent tube 459. When the float reaches its upper level, the vent tube is closed and gas line 461 is opened, allowing pressurized gas to enter from pressurized gas source 463, which is a tank of compressed air regulated by a pressure regulator 465 and a pressure monitor assembly 467.

The opening and closing of openings in the pods by each of the valve elements is repeated as fluid is pumped from a downhole location. Each time the bistable seesaw member changes position two times, a full pumping cycle is completed. Each pumping cycle displaces a predetermined volume of fluid. In this manner, the pumping cycles can be counted and recorded, thereby enabling total volume pumped or volume flow rate to be calculated and recorded or displayed.

The preferred method of counting pumping cycles is to monitor changes in pressure in the compressed gas supply line connecting the pressurized line 461 to the gas source 463. Each time the valve element associated with the pressurized line opens, the pressure in the compressed gas supply line drops to a lower pressure. When the valve element closes, the pressure in the gas supply line recovers to the regulated level. Each dip in the compressed gas line supply can be detected, as illustrated in FIG. 14. The gas pressure assembly 467 is shown to include a pressure sensor 471 which produces an electrical signal representing gas pressure. This signal is sent to a comparator 473 which compares the pressure signal to a preset threshold. When the pressure signal drops below the threshold, an electrical signal is generated which triggers a trigger circuit 475, such as a one shot circuit. The output of the trigger circuit registers a count at a counter 477. The number of counts in the counter 477 may be computed in a volume calculation circuit 479 which multiplies the number of counts by the known volume of the housing in a full condition. The pumped volume per unit time is the flow rate, i.e. a flowmeter determination.

An alternative volume calculation mechanism is shown in FIG. 15 where a pneumatic pressure pulse counter 481 detects a pressure wave from line 461 in FIG. 13 rather than an electrical signal. The pressure wave generates a pulse which registers at a pulse counter and display 483, where a volume calculation may be made.

I claim:

1. A pneumatic pump for fluid comprising:

a housing having an opening, a bottom wall opposite to said opening, and a sidewall extending between said opening and said bottom wall, said housing including a sealable fluid entry aperture;

a pipe communicating between an interior and an exterior of said housing, with said housing movably attached to said pipe for axial displacement therewith, said pipe allowing flow to the exterior of the housing in response to gas pressure on fluid in the housing; and a switchable valve control having a seesaw member and a pod, said pod fitting into said opening and including a plurality of valve seats, with said seesaw member having two ends supporting a plurality of valve elements with said housing connecting to one end of said seesaw member to actuate said seesaw member in response to a level of fluid in said housing, with said plurality of valve seats defining at least one fluid inlet port and at least one fluid outlet port, wherein said valve elements are positioned to alternatingly seal said inlet and outlet ports in relation to the axial displacement of said housing allowing both fluid to ingress through said sealable fluid entry aperture and fluid to egress through said pipe.

2. The pump as recited in claim 1 wherein said pipe is coaxially disposed within said housing.

3. The pump as recited in claim 1 further including a resilient member disposed proximate to said bottom wall to establish a force of fluid in said housing necessary to actuate said valve elements to alternatingly seal said inlet and outlet ports.

4. The pump as recited in claim 1 wherein each of said plurality of valve elements is positioned inside said housing and includes a frusto-conical portion extending upwardly and inwardly so as to fit against said valve seat in said pod.

5. The pump as recited in claim 1 further including a liquid flow metering system having means for counting a number of switches made by said switchable valve control.

6. The pump as recited in claim 5 further including a gas pressure supply line connected to said inlet port wherein said means for counting said number of switches made by said switchable valve control includes a transducer generating an electrical signal responsive to pressure changes in said gas pressure supply line and a counter recording said electrical signals generated by said transducer.

7. The pump as recited in claim 1 wherein said pod includes an aperture through which said pipe passes and further including a first flexible member disposed in said aperture between said pipe and said pod to maintain a fluid-tight seal therebetween.

8. The pump as recited in claim 7 wherein said bottom wall includes an orifice located opposite said aperture, said orifice including a second flexible member to maintain a fluid-tight seal about said orifice to facilitate axial displacement of said housing.

9. The pump as recited in claim 7 wherein said flexible member is a rolling diaphragm.

10. The pump as recited in claim 7 wherein said flexible member is a bellows.

11. A pneumatic pump for fluid comprising:

a housing having an opening, a bottom wall opposite to said opening, and a sidewall extending between said opening and said bottom wall, said housing including a sealable fluid entry aperture;

a pipe communicating between an interior and an exterior of said housing, with said housing movably attached to said pipe for axial displacement therewith, said pipe allowing flow to the exterior of the housing in response to gas pressure on fluid in the housing; and a switchable valve control having a pod, closing said opening, and a seesaw member being pivotally attached to said pod and including a plurality of valve elements, said pod including a plurality of valve seats, with each of said plurality of valve elements being positioned inside said housing and including a frusto-conical portion extending upwardly and inwardly so as to fit against a valve seat in said pod, with said plurality of valve seats defining at least one fluid inlet port and at least one fluid outlet port, wherein said valve elements alternatingly seal said inlet and outlet ports in relation to the axial displacement of said housing allowing both fluid to ingress through said sealable fluid entry aperture and fluid to egress through said pipe.

12. The pump as recited in claim 11 wherein said pipe is coaxially disposed within said housing.

13. The pump as recited in claim 11 further including a liquid flow metering system and a gas pressure supply line connected to said inlet port with said metering system having means for counting a number of switches made by said switchable valve control, counting means including a transducer generating an electrical signal responsive to pressure changes in said gas pressure supply line and a counter recording said electrical signals generated by said transducer.

14. The pump as recited in claim 11 further including a resilient member disposed proximate to said bottom wall to establish a force of fluid in said housing necessary to actuate said valve elements to alternatingly seal said inlet and outlet ports.

* * * * *